US007136022B2

(12) United States Patent
Sato et al.

(10) Patent No.: US 7,136,022 B2
(45) Date of Patent: Nov. 14, 2006

(54) RADIO APPARATUS

(75) Inventors: Koichi Sato, Tokyo (JP); Takashi Amano, Saitama-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 11/138,851

(22) Filed: May 25, 2005

(65) Prior Publication Data

US 2006/0152419 A1 Jul. 13, 2006

(30) Foreign Application Priority Data

Jan. 11, 2005 (JP) ..... 2005-004061

(51) Int. Cl.
*H01Q 1/24* (2006.01)

(52) U.S. Cl. ..... 343/702

(58) Field of Classification Search ..... 343/702, 343/700 MS

See application file for complete search history.

(56) References Cited

U.S. PATENT DOCUMENTS

| | | | | |
|---|---|---|---|---|
| 4,138,681 | A * | 2/1979 | Davidson et al. | 343/702 |
| 5,598,169 | A * | 1/1997 | Drabeck et al. | 343/701 |
| 6,734,825 | B1 * | 5/2004 | Guo et al. | 343/700 MS |
| 6,861,986 | B1 * | 3/2005 | Fang et al. | 343/700 MS |

FOREIGN PATENT DOCUMENTS

| | | |
|---|---|---|
| JP | 11-68453 A | 3/1999 |
| JP | 2004-96314 A | 3/2004 |

OTHER PUBLICATIONS

Antenna Engineering Handbook, pp. 112-113, Figures 4.1 and 4.3, edited by The Institute of Electronics, Information and Communication Engineers, Ohm-sha, Oct. 1996.

Dual-Band Folded Antenna with Two Shorted Points, by K. Sato and T. Amano, IEICE General Conference B-1-57, The Institute of Electronics, Information and Communication Engineers, Mar. 2004.

* cited by examiner

*Primary Examiner*—Tho Phan
(74) *Attorney, Agent, or Firm*—Frishauf, Holtz, Goodman & Chick, P.C.

(57) ABSTRACT

There is provided a radio apparatus usable in a frequency band of use comprising a feeder circuit, a first antenna element and a second antenna element. The first antenna element having a first end connected to the feeder circuit and a grounded second end includes a forward path and a backward path short-circuiting to each other at a shorting bridge, and is a half wavelength long of a first frequency in the band of use. The distance between the first end and the second end is no greater than one-tenth wavelength of the first frequency. The second antenna element begins with the first end, shares a part of the forward path with the first antenna element, diverges from the forward path at a diverging point before the shorting bridge, comes to an open end and is one-fourth wavelength long of a second frequency in the band of use.

8 Claims, 11 Drawing Sheets

RADIO APPARATUS

CROSS REFERENCE TO RELATED APPLICATIONS

This application is based upon and claims the benefit of priority from the prior Japanese Patent Application No. 2005-4061 filed on Jan. 11, 2005; the entire contents of which are incorporated herein by reference.

FIELD OF THE INVENTION

The present invention relates to a radio apparatus having an antenna.

DESCRIPTION OF THE BACKGROUND

Recently developed radio apparatuses like mobile phones have internal antennas rather than those to be pulled out of their cases when used, like flexible whip antennas. Using internal antennas for radio apparatuses greatly facilitates their handling or holding and increases a degree of flexibility of their case design, particularly using a thinner case.

A conventional radio apparatus having an internal antenna in a small case may cause decreasing the antenna input impedance as the antenna is located very close to metallic portions of surrounding circuits within the case. That may cause a mismatch between the antenna and its feeder circuit to degrade a performance of the radio apparatus.

In such circumstances it is known that a conventional, named folded dipole antenna may be used not to decrease the antenna input impedance too much. Two or more dipole elements are placed in parallel very closely to configure a folded dipole antenna. An end of one of the dipole elements is connected to an end of the rest of them and so are the other ends, and one of them is fed at a central feeding point. It is usually configured symmetric about the feeding point. This folded dipole antenna is disclosed, for example, in the following document:

"Antenna Engineering Handbook", pp. 112–113, Figures. 4.1 and 4.3 (in Japanese), edited by The Institute of Electronics, Information and Communication Engineers, Ohmsha, October 1996.

A folded dipole antenna may have impedance higher than a simple dipole antenna without being folded, and the value of impedance may be adjusted by the ratio of diameters of the dipole elements placed in parallel. A dipole antenna, however, does not fit a small-sized radio apparatus, particularly one of multiple functions leaving limited space to enclose an antenna, by nature due to its size. A folded dipole antenna may be even worse due to its complicated shape.

A radio apparatus of multiple uses or of multiple standards these days is required to have an antenna of a wider range. Plural antenna elements of various resonant frequencies need to be assembled to form an antenna of multi-frequency resonance. Each antenna element is thereby required to be smaller in size and simpler in shape than, for example, the folded dipole type.

One half of a folded dipole antenna configured symmetric can be used as a monopole antenna fed at its one end and grounded at the other end. This is called a folded monopole antenna, equivalent to the folded dipole antenna in electrical features except for having half the input impedance of the folded dipole antenna, and its application to small-sized radio apparatuses is being studied. An example of such a study is disclosed in the following reference:

Sato, K. and Amano, T, "Dual-band folded antenna with two shorted points", IEICE General Conference B-1-57 (in Japanese), The Institute of Electronics, Information and Communication Engineers, March 2004.

This "dual-band folded antenna" is configured to have two resonant frequencies as an assembly of a pair of folded monopole antenna elements of a rather low-profile type so called inverted-L, each of which has its own resonant frequency. Advantages of this configuration are showing a feature of multi-frequency resonance, fitting a radio apparatus of a thinner case, and facilitating matching impedance of the one element by short-circuiting the forward and backward paths of the other element at a point on those paths.

This configuration, however, still has a disadvantage that needs two or more folded antenna elements to be assembled, and may not fit a small-sized radio apparatus of multiple functions, particularly for present and future use, leaving limited space to enclose an antenna.

SUMMARY OF THE INVENTION

To solve the technical problem described above, an advantage of the present invention is to provide a radio apparatus having an antenna producing multi-frequency resonance and capable of matching impedance and being enclosed in limited space within the case.

According to one aspect of the present invention to achieve the above advantage, there is provided a radio apparatus usable in a frequency band comprising a feeder circuit, a first antenna element and a second antenna element.

The first antenna element has a first end connected to the feeder circuit and a second end, folds back at a folding portion to include a forward path from the first end to the folding portion and a backward path from the folding portion to the second end, and is a half wavelength long of a first frequency in the frequency band. The second end is grounded and located no farther than one-tenth wavelength of the first frequency away from the first end. The forward path and the backward path short-circuit at a shorting bridge.

The second antenna element begins with the first end, shares a part of the forward path with the first antenna element, diverges from the forward path at a diverging point between the first end and the shorting bridge, comes to an open end, and is one-fourth wavelength long of a second frequency in the frequency band.

DETAILED DESCRIPTION OF THE INVENTION

Figure 1:
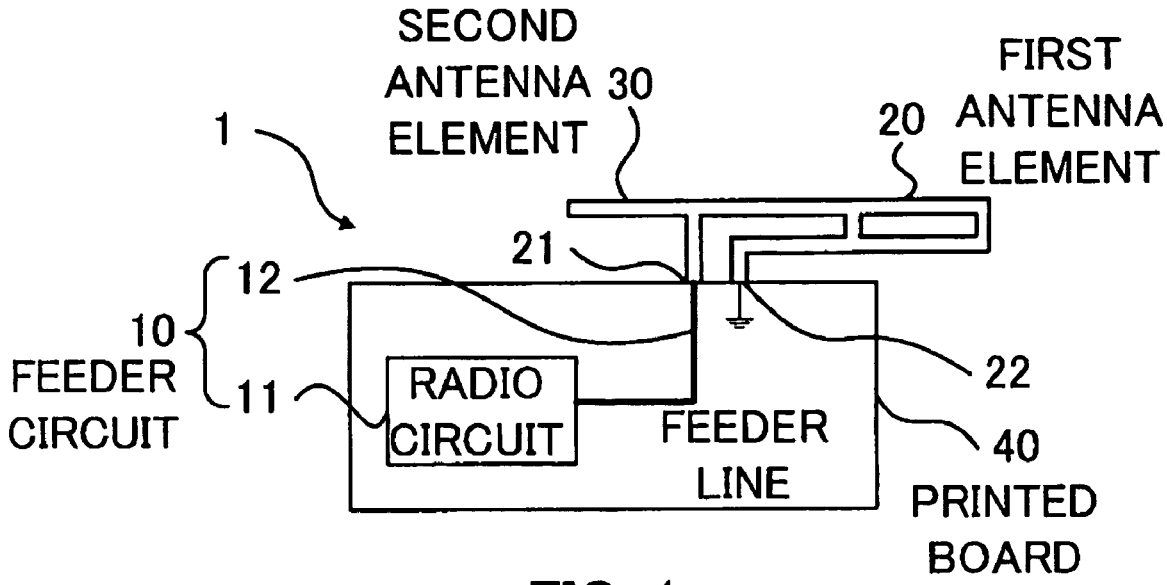
FIG. 1 illustrates a configuration of a main part of a radio apparatus in a first embodiment of the present invention.

A first embodiment of the present invention will be described with reference to FIG. 1 through FIG. 5. FIG. 1 illustrates a configuration of a main part of a radio apparatus 1 in the first embodiment. The radio apparatus 1 is usable in a frequency band i.e., a band of use. The radio apparatus 1 has a feeder circuit 10, a first antenna element 20 and a second antenna element 30. The feeder circuit 10 has a radio circuit 11 and a feeder line 12. The radio circuit 11 has either or both a transmitter and a receiver that are not shown. The first antenna element 20 and the second antenna element 30 shares a part of them, which will be described in detail later with reference to FIG. 4.

The radio apparatus 1 has a case like ordinary radio apparatuses. Other components like a speaker, a microphone, a display, a control circuit and so forth are not shown either.

The radio apparatus 1 has a printed board 40. The feeder circuit 10 is mounted on the printed board 40, and the first antenna element 20 and the second antenna element 30 are attached to the printed board 40. There may be another configuration without the printed board 40, where the feeder circuit 10, the first antenna element 20 and the second antenna element 30 may be attached to, e.g., the case not shown instead. Including the printed board 40 in this configuration, however, makes the description easier to comprehend as radio apparatuses usually have printed boards.

The first antenna element 20 has two ends, a first end 21 and a second end 22. The first end 21 is connected to the feeder line 12 and it is thereby a feeding point of the first antenna element 20. The second end 22 is grounded on the printed board 40. The distance between the first end 21 and the second end 22 has an upper limit as the first antenna element 20 is a kind of folded monopole antennas, which will be described later with reference to FIG. 2.

Figure 2:
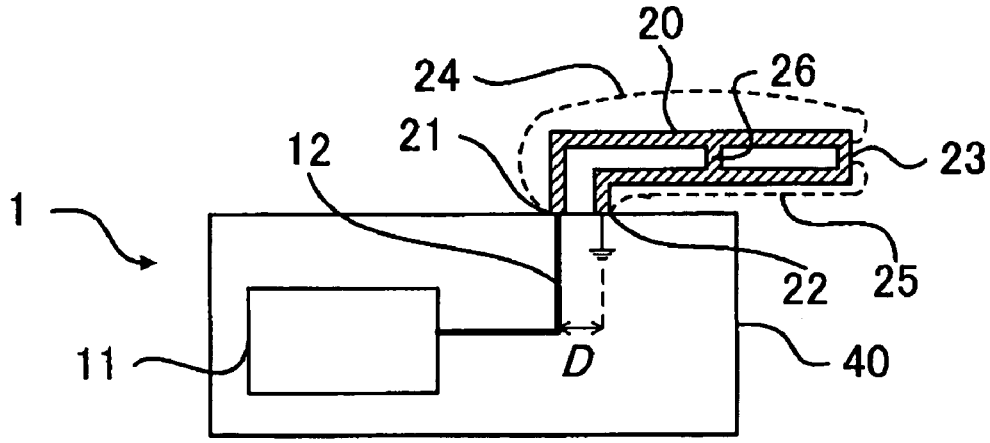
FIG. 2 illustrates a configuration of a first antenna element shown in FIG. 1 in the first embodiment.
Figure 3:
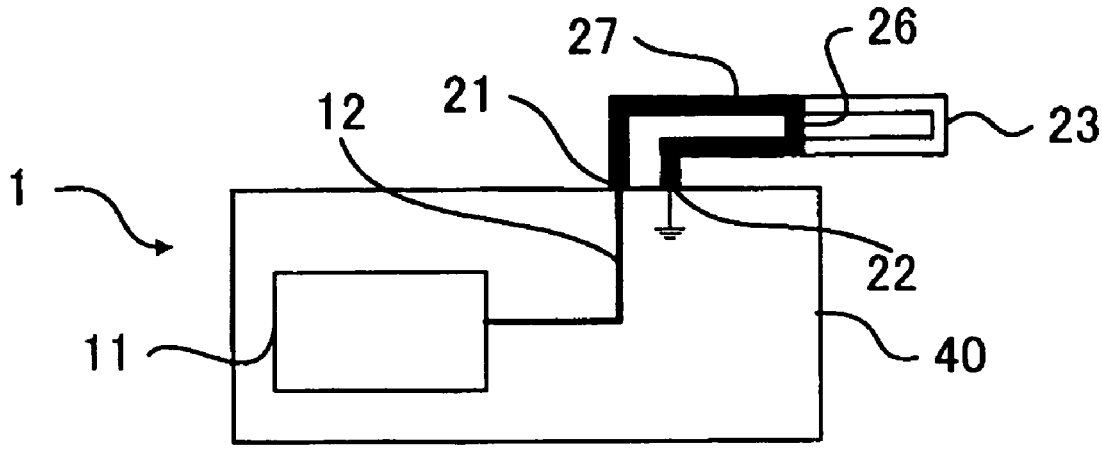
FIG. 3 illustrates a configuration of a returning path included in the first antenna element in the first embodiment.

Configurations of the first antenna element 20 and the second antenna element 30 will be described in detail with reference to FIG. 2 through FIG. 4. FIG. 2 illustrates a configuration of the first antenna element in the first embodiment. Parts belonging only to the second antenna element 30 in FIG. 1 are not shown in FIG. 2 to highlight the configuration of the first antenna element 20. The hatched part of FIG. 2 is the first antenna element 20. Each component given the reference numeral 1, 11, 21, 22 or 40 is the same as the corresponding one shown in FIG. 1 and its explanation is omitted.

The first antenna element 20 begins with the first end 21, folds back at a folding portion 23 and reaches the second end 22 to be grounded. A part of the first antenna element 20 from the first end 21 to the folding portion 23 is a forward path 24. A part of the first antenna element 20 from the folding portion 23 to the second end 22 is a backward path 25.

The length of the first antenna element 20 from the first end 21, along the forward path 24, via the folding portion 23, along the back-ward path 25, and to the second end 22 is equal to a sum of the length of the forward path 24 and the length of the backward path 25. The length of the first antenna element 20 is a half wavelength of a first frequency in the band of use. The forward path 24 and the back-ward path 25 are placed close to each other, and the second end 22 is located no farther than one-tenth wavelength of the first frequency away from the first end 21 (i.e., in FIG. 2, "D" is no greater than one-tenth wavelength of the first frequency).

The first antenna element 20 is thus configured to be a folded monopole antenna and produces resonance at the first frequency. The upper limit of the distance between the first end 21 and the second end 22 of one-tenth wavelength of the resonant frequency stems from technical experiences based on which the configuration works as a folded monopole antenna.

The forward path 24 and the backward path 25 short-circuit at a shorting bridge 26. An effect of this short-circuiting will be described later with reference to FIG. 5.

The first antenna element 20 includes a returning path 27 which will be described with reference to FIG. 3. FIG. 3 illustrates a configuration of the returning path 27. The part drawn filled with black in FIG. 3 is the returning path 27. Each component given the reference numeral 1, 11, 12, 21, 22, 23, 26 or 40 is the same as the corresponding one shown in FIG. 2 and its explanation is omitted.

The returning path 27 begins with the first end 21, returns at the shorting bridge 26 and reaches the second end 22. In other words, the returning path 27 is formed by a part of the forward path 24 from the first end 21 to the shorting bridge 26 and a part of the backward path 25 from the shorting bridge 26 to the second end 22.

Figure 4:
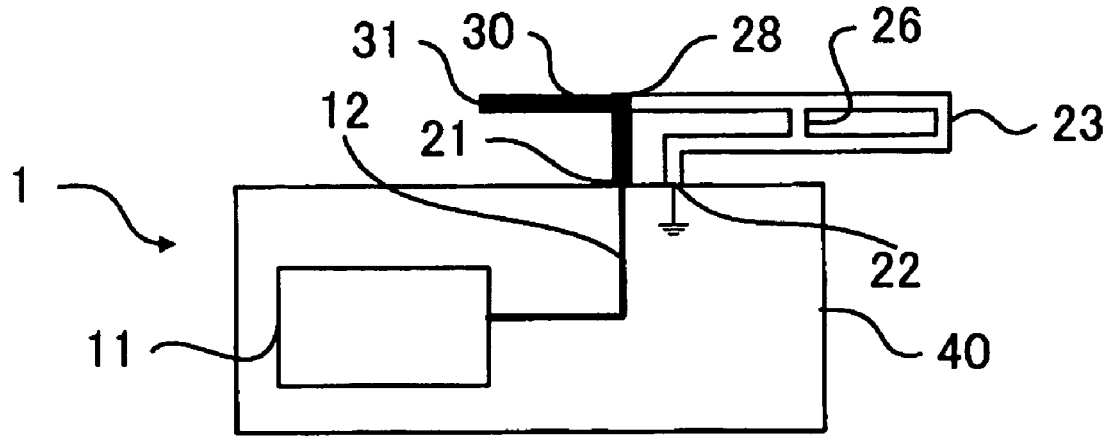
FIG. 4 illustrates a configuration of a second antenna element shown in FIG. 1 in the first embodiment.

FIG. 4 illustrates a configuration of a second antenna element 30 in the first embodiment. The part drawn filled with black in FIG. 4 is the second antenna element 30. Each component given the reference numeral 1, 11, 12, 21, 22, 23, 26 or 40 is the same as the corresponding one shown in FIG. 2 and its explanation is omitted.

The second antenna element 30 shares a part of the forward path 24 from the first end 21 to a diverging point 28 between the first end 21 and the shorting bridge 26 with the first antenna element 20, diverges from the forward path 24 at the diverging point 28 and has an open end 31.

The length of the second antenna element 30 from the first end 21 via the diverging point 28 to the open end 31 is one-fourth wave-length of a second frequency in the band of use. The second antenna element 30 is thus configured to be a monopole antenna and produces resonance at the second frequency. Setting the second frequency to a value different from the first frequency gives the radio apparatus 1 two antenna resonant frequencies and thus may broaden its antenna frequency range.

Figure 5:
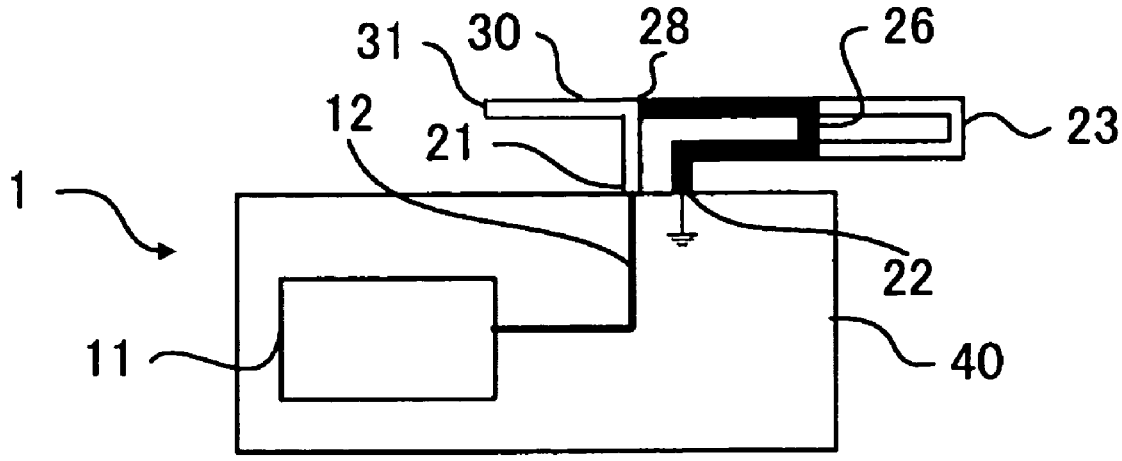
FIG. 5 illustrates that a portion of the returning path shown in FIG. 3 works as an impedance matching circuit of the second antenna element in the first embodiment.

FIG. 5 illustrates a configuration of a portion of the returning path 27 which begins with the diverging point 28, returns at the shorting bridge 26 and reaches the second end 22, and is drawn filled with black in FIG. 5. This portion works as an impedance matching circuit of the second antenna element 30 in the first embodiment. The shorting bridge 26 is basically positioned in the first antenna element 20 so that the impedance matching circuit is around a half wavelength long of the second frequency. The shorting bridge 26 may be positioned no farther to the first end 21 than the above basic position. The nearer the shorting bridge 26 is positioned to the first end 21, the higher the input impedance of the second antenna element 30 becomes. The length of the impedance matching circuit may be set to an appropriate value no greater than around a half wavelength of the resonant frequency of the second antenna element 30 so that its impedance is matched.

According to the first embodiment described above, a combination of a folded monopole antenna with shorting its forward and backward paths and an ordinary, simply shaped monopole antenna gives the radio apparatus two-frequency resonance and impedance matching of its antenna at the same time, and makes the radio apparatus capable of being enclosed in limited space.

A second embodiment of the present invention will be described with reference to FIG. 6 to FIG. 8. A radio apparatus in the second embodiment adopts the same configuration as the one in the first embodiment shown in FIG. 1 through FIG. 5 except that the lengths of the first and second antenna elements, the distance between the first end and the second end, and the length of a portion of the returning path working as an impedance matching circuit of the second antenna element are given different definitions. Each component of the second embodiment is thus given the same reference numeral as the corresponding one shown in the first embodiment.

Figure 6:
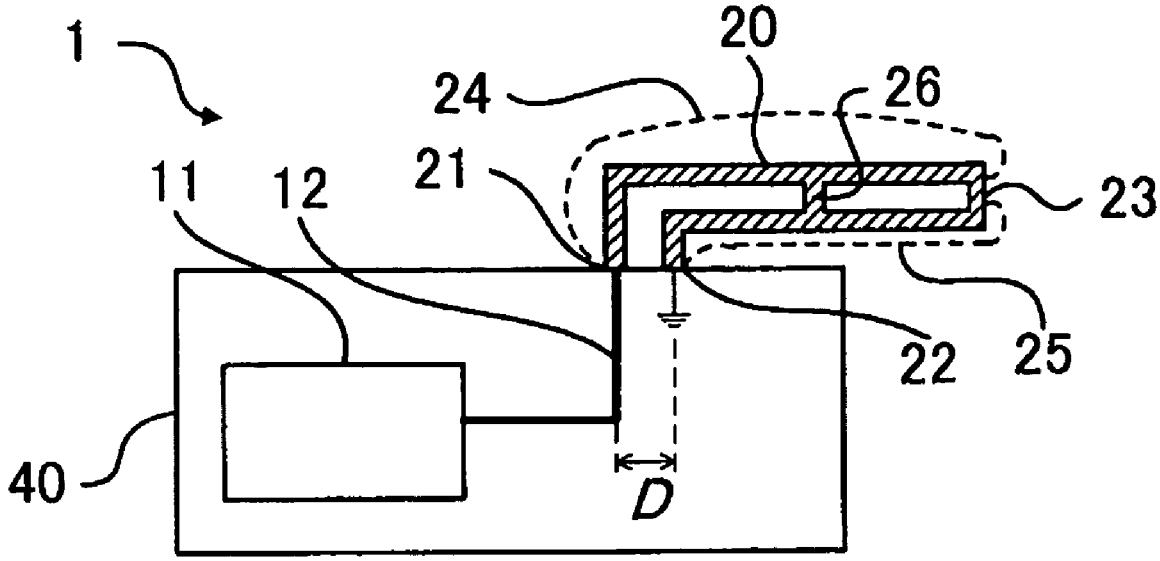
FIG. 6 illustrates a configuration of a first antenna element of a second embodiment of the present invention.

FIG. 6 illustrates a configuration of a first antenna element 20 in the second embodiment, like FIG. 2 in the first embodiment. Every component shown in FIG. 6 is the same as the corresponding one shown in FIG. 2 given the same reference numeral and its explanation is omitted. The length of the first antenna element 20 from the first end 21 via the folding portion 23 to the second end 22 is equal to a sum of the length of the forward path 24 and the length of the backward path 25. The length of the first antenna element 20 is selected as a half wavelength of a desired frequency in the band of use. It may be defined to be no less than a half wavelength of the highest frequency of the band of use and no greater than a half wavelength of the lowest frequency of the band of use.

As a resonant frequency is not specifically determined by the length of the first antenna element 20 defined above, the distance between the first end 21 and the second end 22 needs a definition different from the one in the first embodiment. A definition that the distance (shown as "D" in FIG. 6) is no greater than one fifth of the length of the first antenna element 20 is equivalent to its definition in the first embodiment.

Figure 7:
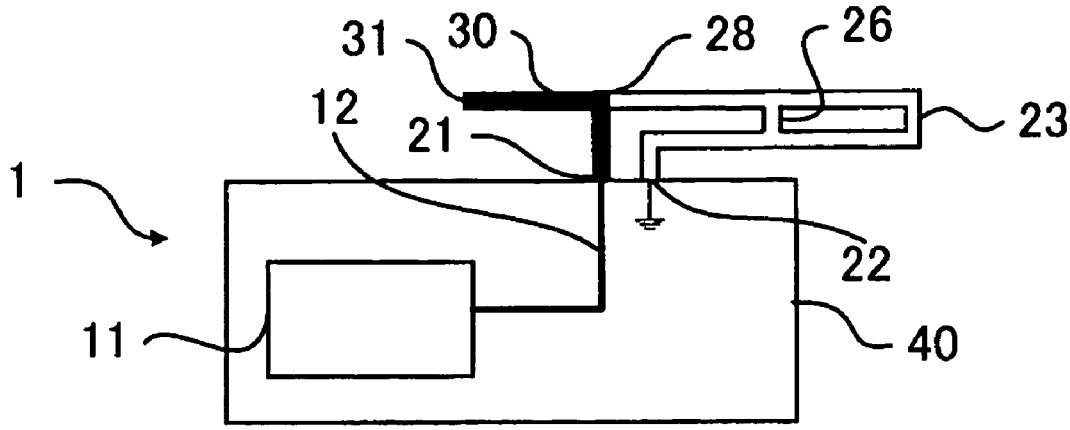
FIG. 7 illustrates a configuration of a second antenna element in the second embodiment.

FIG. 7 illustrates a configuration of a second antenna element 30 in the second embodiment, like FIG. 4 in the first embodiment. Every component shown in FIG. 7 is the same as the corresponding one shown in FIG. 4 given the same reference numeral and its explanation is omitted. The length of the second antenna element 30 from the first end 21 via the diverging point 28 to the open end 31 is selected as one-fourth wavelength of another desired frequency in the band of use. It may be defined to be no less than one-fourth wave-length of the highest frequency of the band of use and no greater than one-fourth wavelength of the lowest frequency of the band of use.

Figure 8:
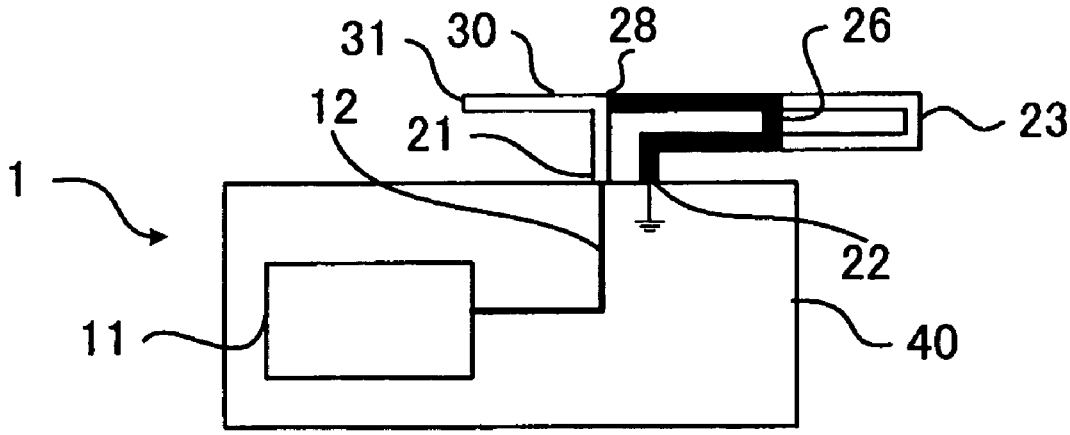
FIG. 8 illustrates that a portion of a returning path included in the first antenna element works as an impedance matching circuit of the second antenna element in the second embodiment.

FIG. 8 illustrates a configuration of a portion of the returning path 27 from the diverging point 28, via the shorting bridge 26 to the second end 22, working as an impedance matching circuit of the second antenna element 30 in the second embodiment, like FIG. 5 in the first embodiment. Every component shown in FIG. 8 is the same as the corresponding one shown in FIG. 5 given the same reference numeral and its explanation is omitted.

As a resonant frequency is not specifically determined by the length of the second antenna element 30 according to the explanation referring to FIG. 7, the length of the impedance matching circuit needs a definition different from the one in the first embodiment.

A definition that the shorting bridge 26 is basically positioned in the first antenna element 20 so that the impedance matching circuit is twice as long as the second antenna element 30 and that the shorting bridge 26 may be positioned no farther to the first end 21 than the above basic position is equivalent to its definition in the first embodiment.

According to the second embodiment described above, different definitions of the lengths and arrangements of the antenna elements may be used to obtain the same effect as the first embodiment.

Figure 9:
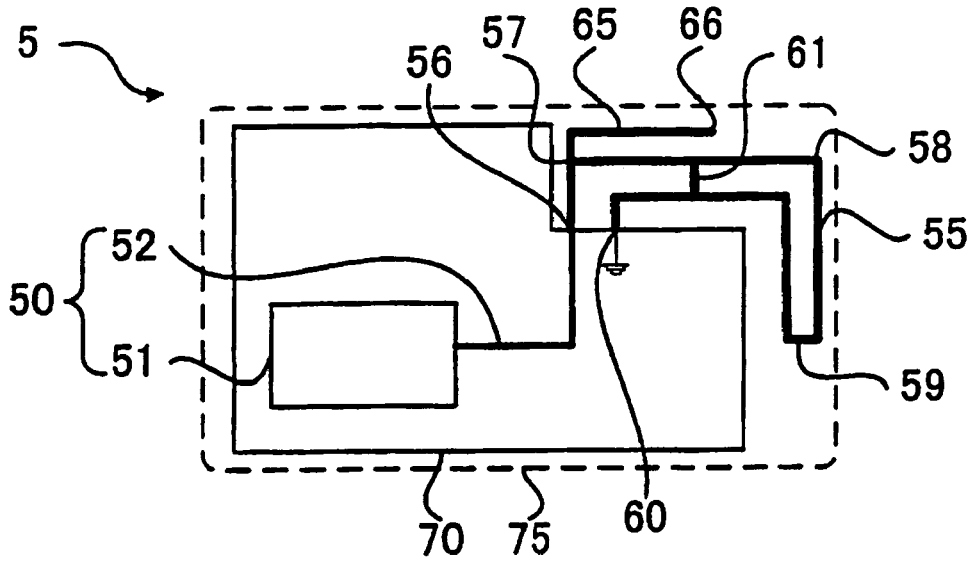
FIG. 9 illustrates a configuration of a main part of a radio apparatus in a third embodiment of the present invention.

A third embodiment of the present invention will be described with reference to FIG. 9. FIG. 9 illustrates a configuration of a main part of a radio apparatus 5 in a third embodiment of the present invention. The radio apparatus 5 is usable in a frequency band of use. The radio apparatus 5 has a feeder circuit 50 that includes a radio circuit 51 and a feeder line 52. The radio circuit 51 has either or both a transmitter and a receiver that are not shown.

The radio apparatus 5 has a first antenna element 55. It begins with a first end 56 connected to the feeder line 52, goes via a diverging point 57 and a bending portion 58, folds back at a folding portion 59 and then reaches a second end 60 to be grounded. The first antenna element 55 has a forward path from the first end 56 to the folding portion 59, and a backward path from the folding portion 59 to the second end 60.

The sum of the lengths of the forward path and the backward path is a half wavelength of a first frequency in the band of use. The forward path and the backward path are placed close to each other, and the second end 60 is positioned no farther than one-tenth wavelength of the first frequency away from the first end 56.

The first antenna element 55 is thus configured to be a folded monopole antenna and produces resonance at the first frequency. The forward path and the backward path short-circuit at a shorting bridge 61. The first antenna element 55 includes a returning path that begins with the first end 56, folds back at the shorting bridge 61 and reaches the second end 60.

The radio apparatus 5 has a second antenna element 65 that shares a part of the first antenna element 55 between the first end 56 and the diverging point 57, diverges at the diverging point 57 and reaches an open end 66. The length of the second antenna element 65 from the first end 56 via the diverging point 57 to the open end 66 is one-fourth wavelength of a second frequency in the band of use.

The second antenna element 65 is thus configured to be a monopole antenna and produces resonance at the second frequency. Setting the second frequency to a value different from the first frequency gives the radio apparatus 5 two antenna resonant frequencies and thus may broaden its antenna frequency range.

A portion of the returning path from the diverging point 57, via the shorting bridge 61 to the second end 60 works as an impedance matching circuit of the second antenna element 65. The shorting bridge 61 is basically positioned in the first antenna element 55 so that the impedance matching circuit is around a half wavelength long of the second frequency.

The shorting bridge 61 may be positioned no farther to the first end 56 than the above basic position to adjust the impedance matching of the second antenna element 65. The length of the impedance matching circuit may be set to an appropriate value no greater than around a half wavelength of the resonant frequency of the second antenna element 65 so that its impedance is matched in a manner similar to the first embodiment.

The feeder circuit 50 is mounted on a printed board 70. The first antenna element 55 and the second antenna element 65 are attached to the printed board 70. The printed board 70, the first antenna element 55 and the second antenna element 65 are enclosed within a case 75 of the radio apparatus 5. A dashed line enclosing the components stated above shows the case 75.

The shapes of the first antenna element 55 and the second antenna element 65 are arranged to be enclosed within the case 75, thus both turned to the same direction and the former bent at the bending portion 58. As this configuration shown in FIG. 9 is just an example, those antenna elements may be shaped in a more complicated manner due to the shape of the case 75 and other arrangement factors.

An advantage of the radio apparatus 5 is to enclose the first antenna element 55 and the second antenna element 65 within the case 75 under various constraints regarding the arrangement therein. A combination of a folded monopole antenna with shorting its forward and backward paths and an ordinary, simply shaped monopole antenna may increase a degree of freedom of radio apparatus designs.

The lengths and arrangements of the antenna elements may be defined in a manner similar to the second embodiment. The length of the first antenna element 55 from the first end 56 via the diverging point 57, the bending portion 58 and the folding portion 59 to the second end 60 may be defined no less than a half wavelength of the highest frequency of the band of use and no greater than a half wavelength of the lowest frequency of the band of use. The distance between the first end 56 and the second end 60 may be defined to be no greater than one fifth of the length of the first antenna element 55.

The length of the second antenna element 65 from the first end 56 via the diverging point 57 to the open end 66 may be defined to be no less than one-fourth wavelength of the highest frequency of the band of use and no greater than one-fourth wavelength of the lowest frequency of the band of use.

The impedance matching circuit from the diverging point 57 via the shorting bridge 61 to the second end 60 may be defined to be no greater than around twice as long as the second antenna element 65 so that the input impedance of the second antenna element 65 is matched.

According to the third embodiment described above, a combination of a folded monopole antenna and a simply shaped monopole antenna has another advantage of being enclosed in limited space within a case of a radio apparatus, as well as two-frequency resonance and impedance matching.

A fourth embodiment of the present invention will be described with reference to FIG. 10 through FIG. 19. The fourth embodiment shows variations of the shapes and arrangements of the antenna elements described in the previous embodiments. Throughout the fourth embodiment, a first antenna element is given a reference numeral 81, a second antenna element is given 82, a first end of the first antenna element 81 to be fed is given 83 and a second end of the first antenna element 81 to be grounded is given 84. Folding back, short-circuiting and diverging of each antenna element are the same as those of the previous embodiments and explanations of them are omitted.

Figure 10:
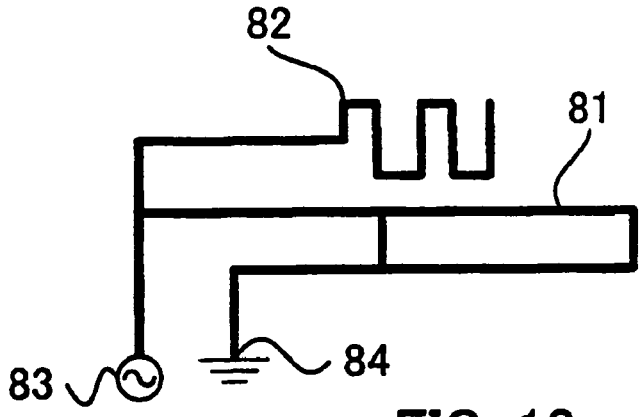
FIG. 10 illustrates a first variation of an antenna element in a fourth embodiment of the present invention.

FIG. 10 shows a meander-shaped second antenna element 82 that meets a requirement of enclosing the second antenna element 82 having a lower resonant frequency within limited space.

Figure 11:
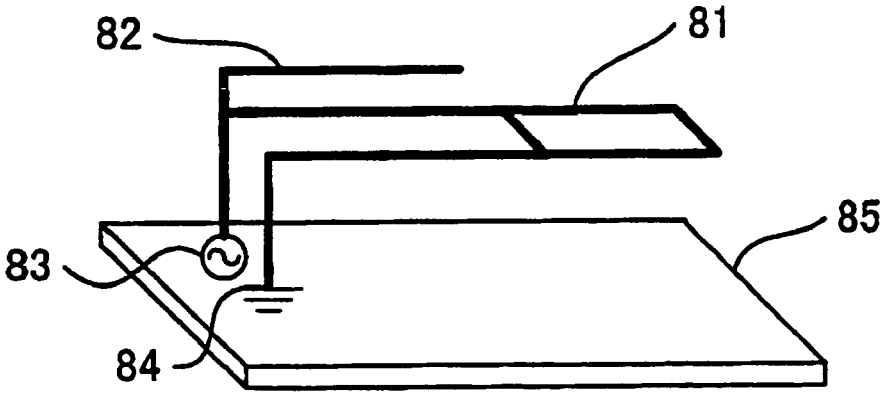
FIG. 11 illustrates a second variation of an antenna element in the fourth embodiment.

FIG. 11 shows a first antenna element 81 and a second antenna element 82 attached to a printed board 85. The first antenna element 81 folds back in a plane parallel to the printed board 85. This configuration fits a thinner case of a radio apparatus.

Figure 12:
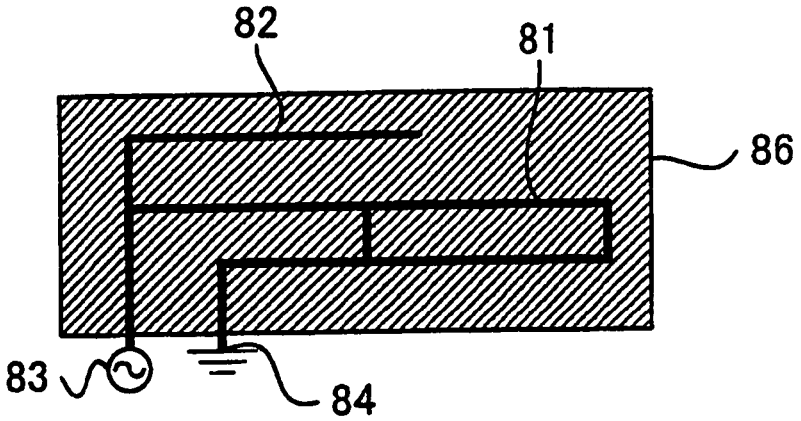
FIG. 12 illustrates a third variation of an antenna element in a fourth embodiment of the present invention.

FIG. 12 shows a first antenna element 81 and a second antenna element 82 formed on a piece of dielectric material 86 shown with hatching. This configuration allows smaller sizes of the first antenna element 81 and the second antenna element 82 due to a wavelength shortening effect of the dielectric material.

Figure 13:
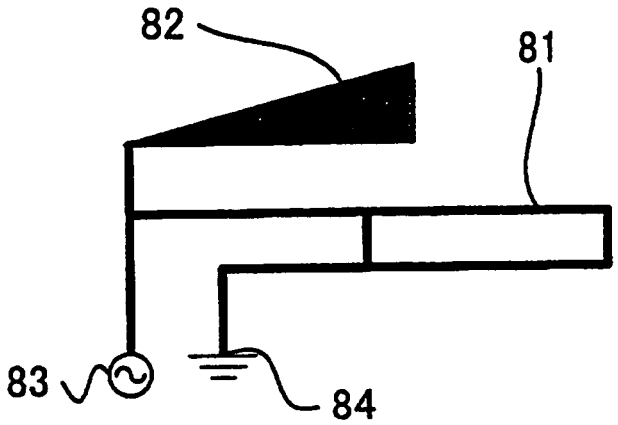
FIG. 13 illustrates a fourth variation of an antenna element in the fourth embodiment.

FIG. 13 shows a second antenna element 82 of a gradually varying width. This configuration contributes to developing a broader frequency range of the antenna configured by the first and the second antenna elements 81 and 82.

Figure 14:
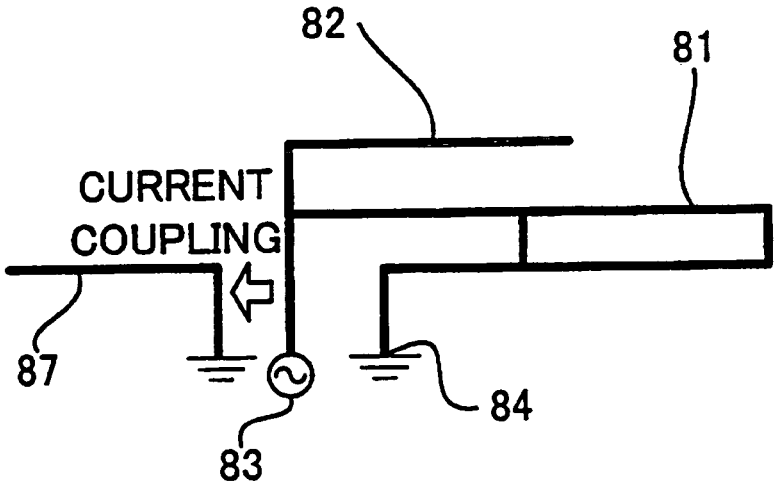
FIG. 14 illustrates a first example of adding a parasitic element in the fourth embodiment.

FIG. 14 shows a parasitic element 87 the one end of which is open and the other end is grounded and current-coupled to a first antenna element 81 or a second antenna element 82. The length of the parasitic element 87 is one-fourth wavelength of another resonant frequency to contribute to developing multi-frequency resonance.

Figure 15:
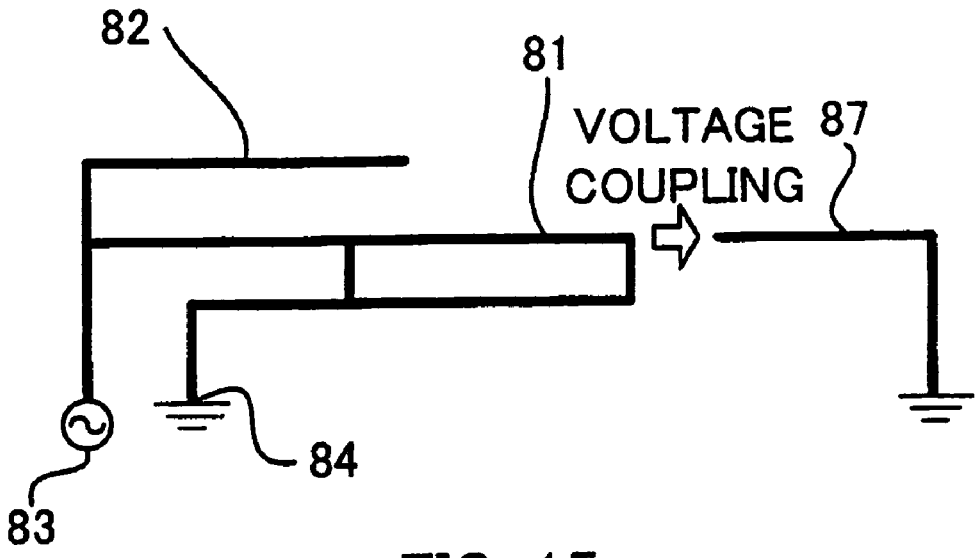
FIG. 15 illustrates a second example of adding a parasitic element in the fourth embodiment.

FIG. 15 shows a parasitic element 87 the one end of which is grounded and the other end is open and voltage-coupled to a first antenna element 81 or a second antenna element 82. The length of the parasitic element 87 is one-fourth wavelength of another resonant frequency to contribute to developing multi-frequency resonance.

Figure 16:
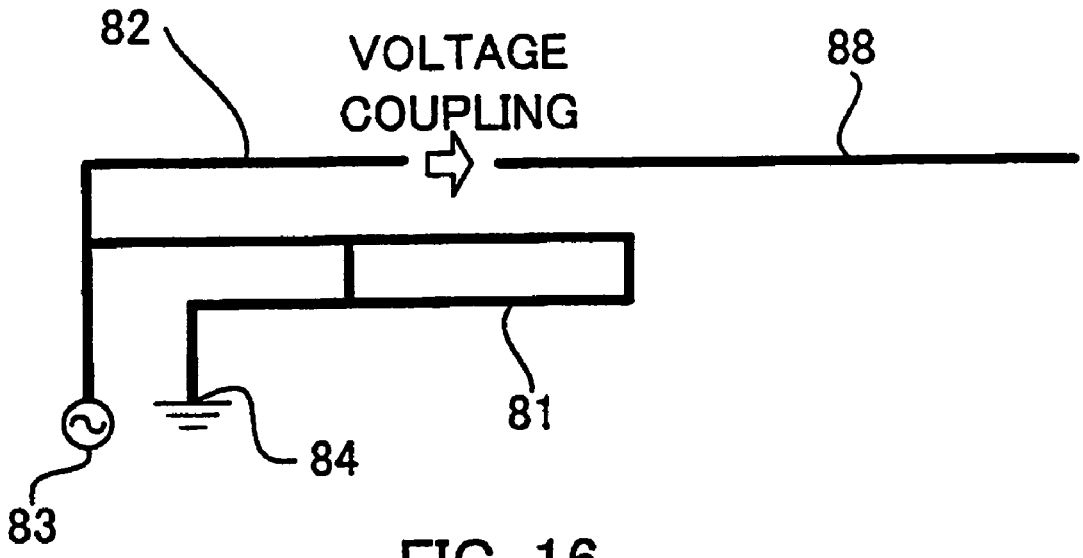
FIG. 16 illustrates a third example of adding a parasitic element in the fourth embodiment.

FIG. 16 shows a parasitic element 88 both ends of which are open and one of them is voltage-coupled to a first antenna element 81 or a second antenna element 82. The length of the parasitic element 88 is a half wavelength of another resonant frequency to contribute to developing multi-frequency resonance.

Figure 17:
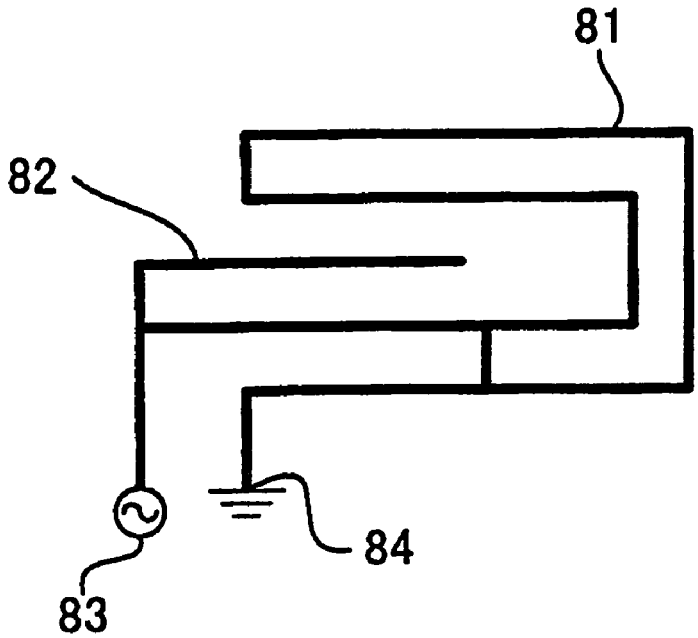
FIG. 17 illustrates a fifth variation of an antenna element in a fourth embodiment of the present invention.
Figure 18:
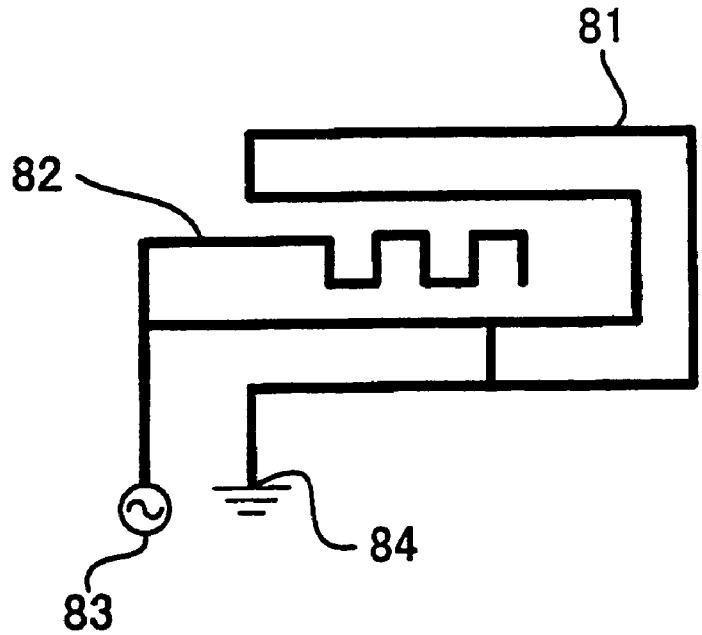
FIG. 18 illustrates a sixth variation of an antenna element in the fourth embodiment.

FIG. 17 shows a first antenna element 81 and a second antenna element 82 turned to the same direction and the former turned again to its fed or grounded end. FIG. 18 shows a meander-shaped second antenna element 82 in the configuration of FIG. 17. Both enable the antenna elements to be enclosed in further limited space, e.g. in mobile phones.

Figure 19:
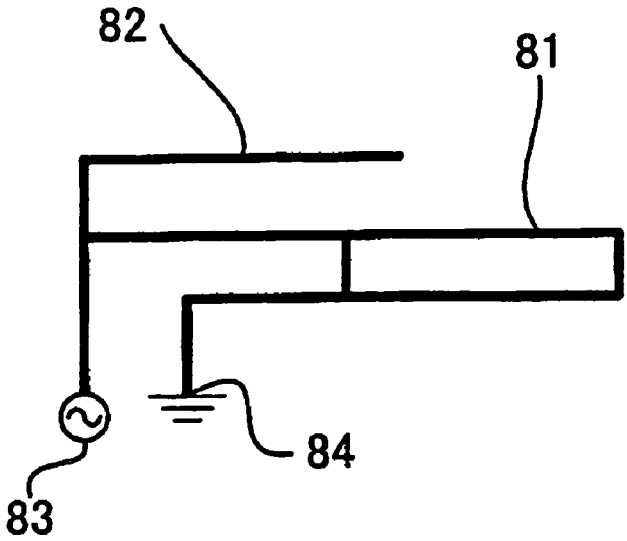
FIG. 19 illustrates a configuration in the fourth embodiment and a VSWR-frequency chart simulated in that configuration.
Figure 19:
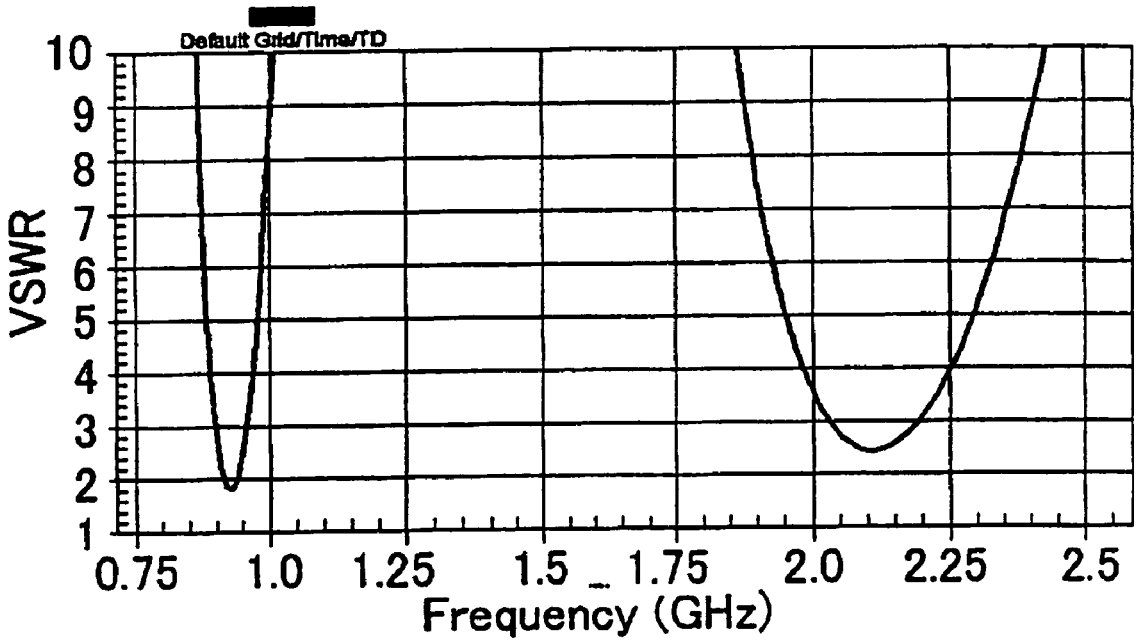

FIG. 19 shows in the upper drawing a configuration of a first antenna element 81 and a second antenna element 82 turned to the same direction, and in the lower drawing a VSWR-frequency chart simulated in that configuration. The plotted curve on the left side of the chart shows a resonance of the first antenna element 81. The plotted curve on the right side of the chart shows a resonance of the second antenna element 82.

According to the fourth embodiment described above, variations of the shapes and arrangements of antenna elements contributes to enclosing them in smaller or thinner cases, or to developing multi-frequency resonance.

Figure 20:
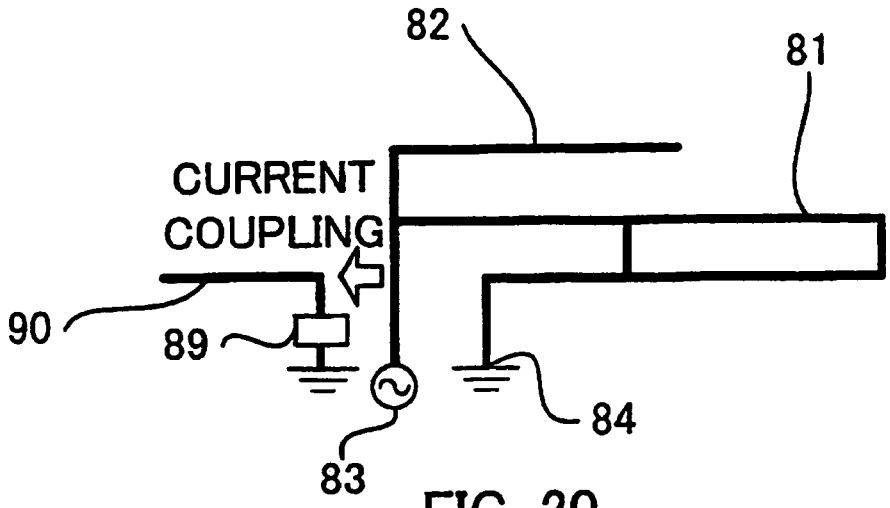
FIG. 20 illustrates an example of downsizing a parasitic element shown in FIG. 14 in a fifth embodiment of the present invention.

A fifth embodiment of the present invention will be described with reference to FIG. 20 through FIG. 22. Parasitic elements in the fourth embodiment to develop multi-frequency resonance will be made smaller in the fifth embodiment. FIG. 20 shows a parasitic element 90 formed by the parasitic element 87 in FIG. 14 plus a matching circuit 89 inserted in series. Each of the other components are the same as the corresponding one shown in FIG. 14 given the same reference numeral and its explanation is omitted. The matching circuit 89 is, e.g. an inductor.

Figure 21:
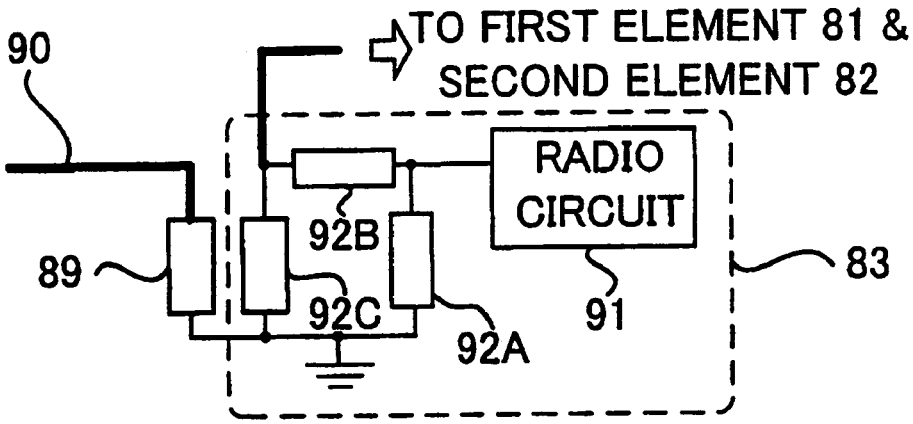
FIG. 21 illustrates an example of how a matching circuit shown in FIG. 20 is attached in the fifth embodiment.

FIG. 21 shows an example of how the matching circuit 89 is attached in FIG. 20. The feeding point at the first end 83 seen from the first antenna element 81 and the second antenna element 82 includes a radio circuit 91 and matching components 92A, 92B and 92C. Those matching components form a matching circuit together for the first antenna element 81 and are mounted on a group of pads placed on a printed board not shown in FIG. 21. The matching circuit 89 is mounted on a member of the group of pads.

The parasitic element 90 with the matching circuit 89 is shorter than the one with no matching circuit, and thus contributes to downsizing. Adjusting the value of the matching circuit 89 enables the resonant frequency of the parasitic element 90 to be fine-tuned.

Figure 22:
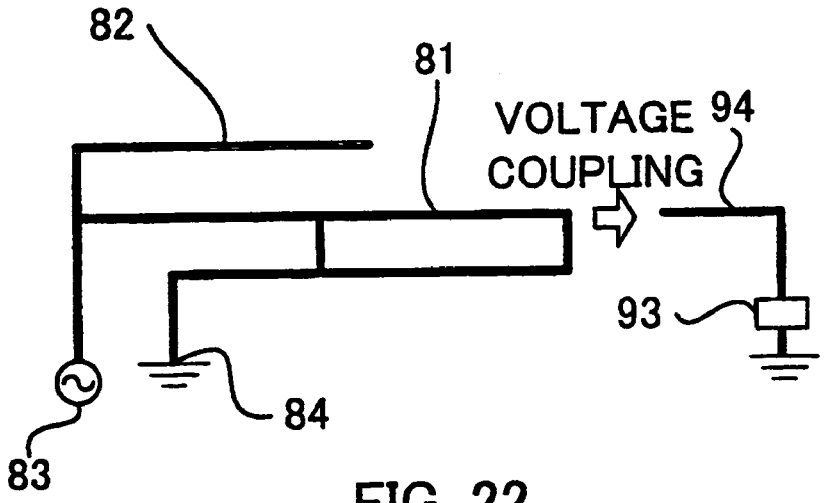
FIG. 22 illustrates an example of downsizing a parasitic element shown in FIG. 15 in the fifth embodiment.

FIG. 22 shows a parasitic element 94 formed by the parasitic element 87 in FIG. 15 plus a matching circuit 93 inserted in series. Each of the other components is the same as the corresponding one shown in FIG. 15 given the same reference numeral and its explanation is omitted. The parasitic element 94 with the matching circuit 93 is shorter than the one with no matching circuit, and thus contributes to downsizing. Adjusting the value of the matching circuit 93 enables the resonant frequency of the parasitic element 94 to be fine-tuned.

According to the fifth embodiment described above, downsized parasitic elements are useful for radio apparatuses of smaller cases and multi-frequency resonance.

The particular hardware or software implementation of the present invention may be varied while still remaining within the scope of the present invention. It is therefore to be understood that within the scope of the appended claims and their equivalents, the invention may be practiced otherwise than as specifically described herein.

What is claimed is:

1. A radio apparatus comprising:

a feeder circuit;

a first antenna element including a first end connected to the feeder circuit and a second end, the first antenna element folding back at a folding portion and having a forward path from the first end to the folding portion and a backward path from the folding portion to the second end, a length from the first end via the folding portion to the second end being a half of a wavelength of a first frequency, the second end being grounded and positioned no farther than one-tenth of the wavelength of the first frequency away from the first end, and the forward path and the backward path short-circuiting at a shorting bridge of the first antenna element; and a second antenna element, which shares with the first antenna element a part of the forward path from the first end to a diverging point between the first end and the shorting bridge, and which has an open end, a length from the first end via the diverging point to the open end being one-fourth of a wavelength of a second frequency, and the second frequency being higher than the first frequency.

2. The radio apparatus of claim 1, wherein a path formed by a part of the forward path from the diverging point to the shorting bridge and a part of the backward path from the shorting bridge to the second end is no longer than about a half of the wavelength of the second frequency.

3. The radio apparatus of claim 1, wherein a path formed by a part of the forward path from the diverging point to the shorting bridge and a part of the backward path from the shorting bridge to the second end has a length for impedance matching of the second antenna element.

4. The radio apparatus of claim 1, further comprising a case, wherein the first antenna element and the second antenna element are enclosed within the case.

5. A radio apparatus usable in frequencies including a highest frequency and a lowest frequency at which the radio apparatus is usable, said radio apparatus comprising:

a feeder circuit;

a first antenna element including a first end connected to the feeder circuit and a second end, the first antenna element folding back at a folding portion and having a forward path from the first end to the folding portion and a backward path from the folding portion to the second end, a length from the first end via the folding portion to the second end being no less than a half of a wavelength of the highest frequency and no greater than a half of a wavelength of the lowest frequency, the second end being grounded and positioned no farther than one fifth of the length of the first antenna element away from the first end, and the forward path and the backward path short-circuiting at a shorting bridge; and a second antenna element, which shares with the first antenna element a part of the forward path from the first end to a diverging point between the first end and the shorting bridge, and which has an open end, a length from the first end via the diverging point to the open end being no less than one-fourth of the wavelength of the highest frequency and no greater than one-fourth of the wavelength of the lowest frequency, and the length of the second antenna element from the first end via the diverging point to the open end being less than half the length of the first antenna element from the first end via the folding portion to the second end.

6. The radio apparatus of claim 5, wherein a path formed by a part of the forward path from the diverging point to the shorting bridge and a part of the backward path from the shorting bridge to the second end is no longer than about twice as long as the second antenna element.

7. The radio apparatus of claim 5, wherein a path formed by a part of the forward path from the diverging point to the shorting bridge and a part of the backward path from the shorting bridge to the second end has a length for impedance matching of the second antenna element.

8. The radio apparatus of claim 5, further comprising a case, wherein the first antenna element and the second antenna element are enclosed within the case.

* * * * *